US009182176B2

(12) United States Patent
Sei

(10) Patent No.: US 9,182,176 B2
(45) Date of Patent: Nov. 10, 2015

(54) HEAT EXCHANGER

(76) Inventor: Chugen Sei, Tokyo (JP)

( * ) Notice: Subject to any disclaimer, the term of this patent is extended or adjusted under 35 U.S.C. 154(b) by 385 days.

(21) Appl. No.: 13/396,534

(22) Filed: Feb. 14, 2012

(65) Prior Publication Data

US 2012/0261099 A1 Oct. 18, 2012

(30) Foreign Application Priority Data

Feb. 15, 2011 (JP) ..... 2011-029610

(51) Int. Cl.

| | |
|---|---|
| ***F28F 3/00*** | (2006.01) |
| ***F28D 7/02*** | (2006.01) |
| ***F28D 15/00*** | (2006.01) |
| ***F28D 9/00*** | (2006.01) |

(52) U.S. Cl.

CPC ..... *F28D 9/0012* (2013.01)

(58) Field of Classification Search

CPC ..... F28D 9/0012; F28D 15/00; F28D 9/005; F28D 9/0018; F28D 9/0031; F28F 3/08

USPC ..... 165/166, 104.34, 164, 165

See application file for complete search history.

(56) References Cited

U.S. PATENT DOCUMENTS

| | | | | | |
|---|---|---|---|---|---|
| 3,865,185 | A * | 2/1975 | Ostbo | 165/165 |
| 4,096,910 | A * | 6/1978 | Coffinberry et al. | 165/81 |
| 4,291,759 | A * | 9/1981 | Sumitomo | 165/146 |
| 4,291,760 | A * | 9/1981 | Argyle et al. | 165/166 |
| 4,624,305 | A * | 11/1986 | Rojey | 165/165 |
| 4,836,276 | A * | 6/1989 | Yamanaka et al. | 165/51 |
| 4,934,454 | A * | 6/1990 | Vandyke et al. | 165/165 |
| 5,099,912 | A * | 3/1992 | Tajima et al. | 165/133 |
| 5,400,854 | A * | 3/1995 | Iio et al. | 165/157 |
| 5,787,977 | A * | 8/1998 | Yuasa et al. | 165/284 |
| 5,832,993 | A * | 11/1998 | Ohata et al. | 165/166 |
| 5,987,885 | A * | 11/1999 | Kizer et al. | 60/298 |
| 6,170,568 | B1 * | 1/2001 | Valenzuela | 165/167 |
| 6,422,305 | B2 * | 7/2002 | Jainek | 165/167 |
| 6,510,894 | B1 * | 1/2003 | Watton et al. | 165/166 |
| 7,013,963 | B2 * | 3/2006 | Laine et al. | 165/157 |
| 7,178,345 | B2 * | 2/2007 | Sobel et al. | 62/51.2 |

(Continued)

FOREIGN PATENT DOCUMENTS

| | | |
|---|---|---|
| JP | 06-273085 | 9/1994 |
| JP | 2000-038963 | 2/2000 |

(Continued)

*Primary Examiner* — Frantz Jules
*Assistant Examiner* — Claire Rojohn, III
(74) *Attorney, Agent, or Firm* — Minder Law Group; Willy H. Wong

(57) ABSTRACT

A low cost heat exchanger exhibits high performance in relation to heat resistance, pressure resistance, prevention of fluid leakage, and heat exchange efficiency. The heat exchanger is equipped with a stacked plate assembly having a plurality of stacked plates, and a hollow tubular casing, which accommodates the stacked plate assembly and extends in the stacking direction. The stacked plate assembly includes the plurality of plates, sealing members for preventing leakage of fluid from fluid paths, and a fixing tool fastening together the plural plates at a position along the central axis thereof. In the heat exchanger, two types of fluids that undergo heat exchange flow in arcuate paths in the interior of hollow portions formed between two adjacent plates, without causing mutual mixing to occur between the two fluids. Adjacent hollow portions are connected in series through bypasses.

14 Claims, 7 Drawing Sheets

(56) References Cited

U.S. PATENT DOCUMENTS

| | | | | |
|---|---|---|---|---|
| 7,749,464 | B2 * | 7/2010 | Sakakura et al. | 422/211 |
| 7,762,090 | B2 * | 7/2010 | Lee | 62/93 |
| 7,789,128 | B2 * | 9/2010 | Rehberg | 165/166 |
| 7,892,847 | B2 * | 2/2011 | Ito | 436/161 |
| 8,266,900 | B2 * | 9/2012 | Shikazono et al. | 60/320 |
| 8,387,666 | B2 * | 3/2013 | Fagerlund et al. | 138/42 |
| 8,430,131 | B2 * | 4/2013 | Fagerlund et al. | 138/42 |
| 2001/0010262 | A1 * | 8/2001 | Komoda | 165/167 |
| 2001/0023760 | A1 * | 9/2001 | Motzet et al. | 165/162 |
| 2002/0162646 | A1 * | 11/2002 | Haasch et al. | 165/109.1 |
| 2003/0000688 | A1 * | 1/2003 | Mathur et al. | 165/167 |
| 2003/0051865 | A1 * | 3/2003 | Stromer et al. | 165/166 |
| 2003/0098146 | A1 * | 5/2003 | Angermann et al. | 165/167 |
| 2003/0178189 | A1 * | 9/2003 | Yoshida et al. | 165/166 |
| 2004/0112579 | A1 * | 6/2004 | Strahle | 165/166 |
| 2004/0182556 | A1 * | 9/2004 | Jahn et al. | 165/166 |
| 2007/0000639 | A1 * | 1/2007 | Ozawa et al. | 165/41 |
| 2008/0023086 | A1 * | 1/2008 | Fagerlund et al. | 137/625.28 |
| 2008/0179049 | A1 * | 7/2008 | Mathur et al. | 165/159 |
| 2009/0255650 | A1 * | 10/2009 | Magill et al. | 165/103 |
| 2010/0186924 | A1 * | 7/2010 | Hiyama | 165/10 |
| 2010/0314084 | A1 * | 12/2010 | Takeuchi et al. | 165/166 |

FOREIGN PATENT DOCUMENTS

| | | | |
|---|---|---|---|
| JP | 2001-263969 | | 9/2001 |
| JP | 2006-127784 | | 5/2006 |
| JP | 2009-024969 | | 2/2009 |
| JP | 2010-038429 | | 2/2010 |
| JP | 2010-071553 | | 4/2010 |
| JP | 2010071553 | A * | 4/2010 |

* cited by examiner

HEAT EXCHANGER

BACKGROUND OF THE INVENTION

1. Field of the Invention

The present invention relates to a heat exchanger for carrying out heat exchange between two fluids. In the present specification, one of the fluids from among the two fluids that undergo heat exchange is referred to as a first fluid, whereas the other fluid is referred to as a second fluid.

2. Description of the Related Art

Several ideas have been offered in the prior art in relation to heat exchangers. Problem points in relation to heat exchangers principally include heat exchange efficiency, heat resistance, pressure resistance, fluid leakage, manufacturing costs, and the like.

The following references may be cited as examples of ideas that have been proposed as efforts to overcome the aforementioned problems. For example, Patent Document 1 discloses a heat exchanger in which aluminum plates and fins are stacked and heat exchange is carried out on air by a coolant liquid, which is said to be excellent in pressure resistance, exhibit good heat exchange efficiency, and does not cause leakage of liquid.

Further, Patent Document 2 discloses a heat exchanger, which is capable of utilizing an exhaust gas effectively, and in which piping is provided through which a liquid flows in a serpentine or spiral pattern about an axis oriented in a direction in which the exhaust gas flows.

Further, Patent Document 3 discloses a heat exchanger in which a metallic inner pipe is inserted in the interior of a metallic outer pipe along a longitudinal direction of the outer pipe, and which is capable of significantly lowering the minimum antifreezing temperature on an inner wall surface of the inner pipe.

Further, Patent Document 4 discloses a heat exchanger in which heat exchange efficiency is improved by mutually twisting together an inner pipe and an outer pipe in a spiral shape.

Further, Patent Document 5 discloses a low cost and high heat exchange efficiency heat exchanger in which a first inner pipe is wound in a spiral shape and made integral with the outer circumferential surface of a second inner pipe.

Further, Patent Document 6 discloses a heat exchanger in which a coolant liquid chamber is formed in a partitioned manner surrounding the outer circumferential surface of a coolant pipe, thereby improving layout and reducing the weight of the heat exchanger.

Further, Patent Document 7 discloses a heat exchanger in which adherence of calcium carbonate with respect to the wall surfaces of fluid paths is controlled, by mutually arranging a first fluid path and a second fluid path via multi-layer disk-shaped heat transfer surfaces, wherein the fluid paths are connected in parallel, the disk-shaped heat transfer surfaces are rotated around central axes thereof, and the relative positioning with respect to adjacent heat transfer surfaces is varied.

Patent Documents

Patent Document 1: Japanese Laid-Open Patent Publication No. 6-273085

Patent Document 2: Japanese Laid-Open Patent Publication No. 2006-127784

Patent Document 3: Japanese Laid-Open Patent Publication No. 2001-263969

Patent Document 4: Japanese Laid-Open Patent Publication No. 2010-38429

Patent Document 5: Japanese Laid-Open Patent Publication No. 2009-24969

Patent Document 6: Japanese Laid-Open Patent Publication No. 2000-38963

Patent Document 7: Japanese Laid-Open Patent Publication No. 2010-71553

SUMMARY OF THE INVENTION

Problem the Invention Aims to Solve

Incidentally, a high demand still exists in the art with respect to improving heat exchange efficiency in the aforementioned heat exchangers, and several companies and individuals continue to carry out research actively in relation thereto.

The present invention has the object of providing a compact and low cost heat exchanger, which exhibits high performance in relation to heat resistance, pressure resistance, prevention of fluid leakage, heat exchange efficiency and the like.

The present invention has been conceived of taking into consideration the above objects, and provides a heat exchanger comprising:

a stacked plate assembly having n stacked plates (where n is a natural number constant satisfying the relation $3 \leq n$);

on each of two mutually adjacent plates from among the n plates, hollow portions are formed between the two plates;

among at least one first hollow portion, which is formed between a $(2x-1)$th plate and a $(2x)$th plate counting in a direction from one end to another end in the stacking direction of the n plates (where x is a natural number variable satisfying the relation $2x \leq n$), a closest first hollow portion to the one end in the stacking direction comprises a first opening that communicates with the exterior of the stacked plate assembly;

among the at least one first hollow portion, a closest first hollow portion to the other end in the stacking direction comprises a second opening that communicates with the exterior of the stacked plate assembly;

in the case that a number of the first hollow portions is two or more, a first bypass is provided that interconnects each of two mutually adjacent first hollow portions from among the two or more first hollow portions;

among at least one second hollow portion, which is formed between a $(2y)$th plate and a $(2y+1)$th plate counting in a direction from the one end to the other end in the stacking direction of the n plates (where y is a natural number variable satisfying the relation $2y+1 \leq n$), a closest second hollow portion to the one end in the stacking direction comprises a third opening that communicates with the exterior of the stacked plate assembly;

among the at least one second hollow portion, a closest second hollow portion to the other end in the stacking direction comprises a fourth opening that communicates with the exterior of the stacked plate assembly;

in the case that a number of the second hollow portions is two or more, a second bypass is provided that interconnects each of two mutually adjacent second hollow portions from among the two or more second hollow portions;

the first hollow portion and the second hollow portion are separated mutually from each other, so that fluid does not flow between the first hollow portion and the second hollow portion;

each of the at least one first bypass is arranged along an outer side surface of a second hollow portion that is positioned between two first hollow portions which are connected mutually by the first bypass in the stacking direction; and each of the at least one second bypass is arranged to penetrate through an inner side of a first hollow portion that is positioned between two second hollow portions which are connected mutually by the second bypass in the stacking direction (first inventive aspect).

In the above first inventive aspect, a configuration may be adopted in which there is further provided a hollow cylindrical casing which extends in the stacking direction and accommodates the stacked plate assembly in an interior thereof;

hollow portions of the casing are separated by the stacked plate assembly into a hollow portion positioned on the one end side and a hollow portion positioned on the other end side in the stacking direction;

the first opening is connected to the exterior of the casing through a third bypass that penetrates through a wall surface of the casing;

the second opening is connected to the exterior of the casing through a fourth bypass that penetrates through a wall surface of the casing;

the third opening is opened with respect to the hollow portion positioned on the one end side from among the hollow portions of the casing; and the fourth opening is opened with respect to the hollow portion positioned on the other end side from among the hollow portions of the casing (second inventive aspect).

Further, in the above second inventive aspect, a configuration may be adopted in which a portion of a wall surface of each of the at least one first bypass constitutes a wall of the casing (third inventive aspect).

Further, in the above second or third inventive aspects, a structure may be adopted in which a fan is provided inside the casing that causes the fluid to flow in the stacking direction (fourth inventive aspect).

Further, in any of the above second through fourth inventive aspects, a structure may be adopted in which a tubular body is provided, which forms a separate fluid path that penetrates in the stacking direction in the interior of the stacked plate assembly communicating between the hollow portion positioned on the one end side and the hollow portion positioned on the other end side among the hollow portions of the casing, such that fluid does not flow through any of the first hollow portions, the first bypasses, the second hollow portions, and the second bypasses, except for the second hollow portion that is connected via the fourth opening (fifth inventive aspect).

Further, in any of the above first through fifth aspects of the invention, a structure may be adopted in which at least an adjacent two plates from among at least two $(2p-1)$th positioned plates (where p is a natural number variable satisfying the relation $2p-1 \leq n$) counting in a direction from the one end to the other end in the stacking direction of the n plates have the same shape; and the two plates, which have the same shape, are stacked in a condition of being rotated through a predetermined angle about a common axis that extends in the stacking direction from a position at which the shapes thereof are in agreement as viewed in the stacking direction (sixth inventive aspect).

Further, in any of the above first through sixth aspects of the invention, a structure may be adopted in which at least an adjacent two plates from among at least two $(2q)$th positioned plates (where q is a natural number variable satisfying the relation $2q \leq n$) counting in a direction from the one end to the other end in the stacking direction of the n plates have the same shape; and the two plates, which have the same shape, are stacked in a condition of being rotated through a predetermined angle about a common axis that extends in the stacking direction from a position at which the shapes thereof are in agreement as viewed in the stacking direction (seventh inventive aspect).

Further, in the sixth or seventh aspect of the invention, a structure may be adopted in which, in relation to each of the n plates, shapes in which outer edges of the plates are projected in the direction of the common axis are of the same shape before and after being rotated through the predetermined angle about the common axis (eighth inventive aspect).

Further, in any of the first through eighth aspects of the invention, a structure may be adopted in which:

$n=2m$ (where m is a natural number variable satisfying the relation $2 \leq m$);

the first hollow portion is formed by mutually securing together a $(2r-1)$th positioned plate (where r is a natural number variable satisfying the relation $r \leq m$) counting in a direction from the one end to the other end in the stacking direction of the two plates, and a $(2r)$th positioned plate counting in a direction from the one end to the other end in the stacking direction of the two plates, thereby constituting each of respective rth positioned plate sets counting in a direction from the one end to the other end in the stacking direction; and the second hollow portion is formed by disposing a sealing material between an sth positioned plate set (where s is a natural number variable satisfying the relation $(s+1) \leq m$) counting in a direction from the one end to the other end in the stacking direction of the plate sets, and an $(s+1)$th positioned plate set counting in a direction from the one end to the other end in the stacking direction of the plate sets, and pressing the two plate sets with respect to the sealing material (ninth inventive aspect).

Further, in any of the first through ninth aspects of the invention, a structure may be adopted in which, in relation to at least one of the first hollow portion and the second hollow portion, a partition plate is provided that impedes flow a fluid in a longitudinal direction from a center of the hollow portion to an outer edge thereof (tenth inventive aspect).

Effect of the Invention

By means of the heat exchanger according to the first aspect of the present invention, for example, because the bypass constituting a flow path for the first fluid is arranged on an outer side, and the bypass constituting a flow path for the second fluid is arranged on an inner side of the plates, the first fluid flows in and flows out in directions roughly perpendicular to the stacking direction of the plates, whereas the second fluid flows in and flows out along the stacking direction of the plates, such that the degree of freedom of the inward and outward flowing directions of the fluids is high.

Further, by means of the heat exchanger according to the second aspect of the present invention, because the hollow tubular shaped casing is provided, positioning can be facilitated by arranging the stacked plate assembly at a predetermined position in the interior of the casing.

Further, by means of the heat exchanger according to the third aspect of the present invention, a portion of the wall surface of the casing doubles as a portion of the wall surface of the first bypass. Therefore, for example, the first bypass can be formed by arranging the plate group that forms the hollow portion so as to open from the inner side with respect to the outer side surface, whereby the cost to form the bypass can be reduced.

Further, by means of the heat exchanger according to the fourth aspect of the present invention, flow of the fluid in the stacking direction can be made to occur in the interior of the casing by the fan.

Further, by means of the heat exchanger according to the fifth aspect of the present invention, even in the event that one end of the casing is not open, fluid that passes through the second hollow portion and flows from the one end to the other end in the axial direction of the casing can be made to flow back to the one end through the tubular body that penetrates in the stacking direction in the interior of the stacked plate assembly, whereby heat exchange between the fluids can be carried out.

Further, by means of the heat exchanger according to the sixth or seventh aspect of the present invention, creation of a flow path is performed by arranging each of the plurality of plates in a positional relationship in which the plates are rotated mutually at an appropriate angle about an axis in the stacking direction. Consequently, for example, plates of the same shape, in which the fluid inlet and fluid outlet thereof are arranged at positions shifted by a predetermined angle, are rotated about the axis by the predetermined angle and stacked, whereby flow paths can be formed between the hollow portions, which are arranged easily and directly.

Further, by means of the heat exchanger according to the eighth aspect of the present invention, the plurality of plates, which are rotated mutually by the predetermined angle about the axis in the stacking direction, are of the same shape and overlapped when viewed in the axial direction. Therefore, by rotating and stacking the plates so that the shapes thereof become the same, positioning among the plates can easily be performed.

Further, by means of the heat exchanger according to the ninth aspect of the present invention, a plate set, which is formed integrally by a fixation method such as welding or the like, can be stacked in an arbitrary number, and the heat exchanger can be realized by pressing the plate sets together in the stacking direction. Consequently, by varying the number of plate sets, the heat exchange efficiency can easily be varied.

Further, by means of the heat exchanger according to the tenth aspect of the present invention, because the flow of fluid in the interior of the hollow portion is diverted by (circumvents) the partition plate, a high heat exchange efficiency can be obtained.

BEST MODE FOR CARRYING OUT THE INVENTION

Figure 1:
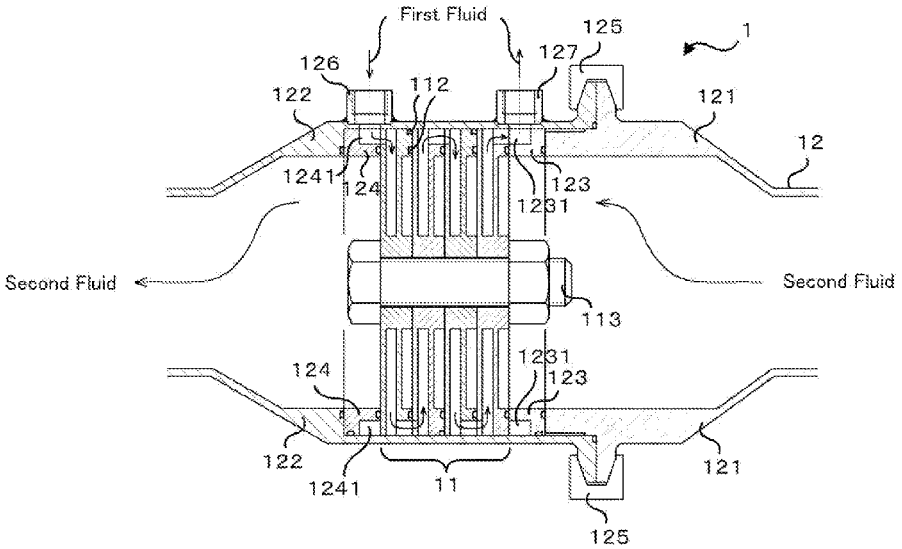
FIG. 1 is a view showing in outline an image of the flow of fluids in the interior of a heat exchanger according to an embodiment of the present invention.

An embodiment, which is one specific example of the present invention, shall be described below with reference to the drawings. FIG. 1 is a cross sectional view showing schematically a heat exchanger 1 according to the present embodiment, and further showing in outline the flow of fluids in the interior thereof.

The heat exchanger 1 comprises a stacked plate assembly 11 having a plurality of stacked plates, and a hollow tubular casing 12 that accommodates the stacked plate assembly 11 therein and which extends in the stacking direction.

Figure 2:
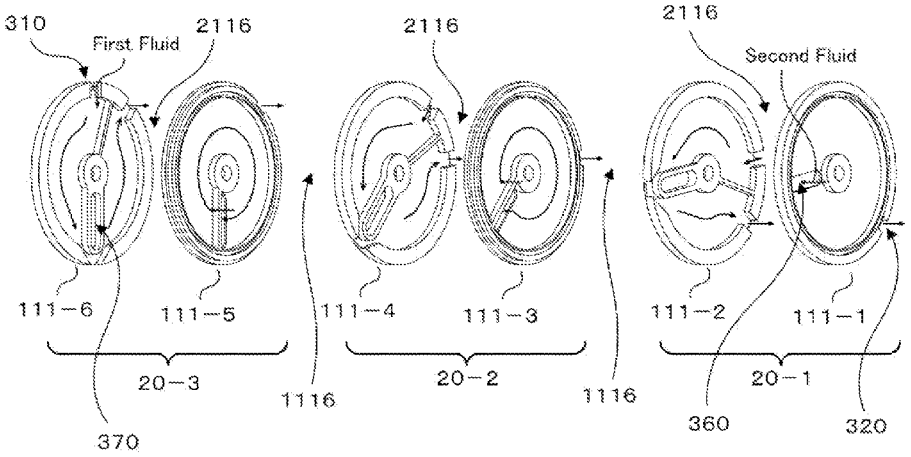
FIG. 2 is a view showing the flow of fluids in the interior of a stacked plate assembly of the heat exchanger according to the embodiment of the present invention.

The stacked plate assembly 11 includes a plurality of plates 111, which are stacked as shown in FIG. 2, sealing members 112 for preventing leakage of flowing fluid from the flow paths, and a fixing tool 113 that fastens the plurality of plates in positions about a central axis. Each of the sealing members 112 is constituted by an o-ring 1121, which is arranged in a ring-shaped recess 11151 on an inner side thereof as viewed from the central axis, and an elastic cord 1122, which is arranged in a cutout 11152 disposed along an outer edge portion of the plates 111. The material of the sealing members 112 may be silicone rubber, for example, although the material is not limited to silicone rubber.

The number of plates 111 can be arbitrarily varied. In FIG. 1, eight plates 111 are used, whereas in FIG. 2, six plates are used.

In each of the drawings, the left-right direction is illustrated as the stacking direction of the plates 111. Below, without any particular limitation, when the stacking direction is referred to, a direction is implied from the right side to the left side in each of the drawings.

As discussed above, the number of plates 111 constituting the stacked plate assembly 11 can be arbitrarily varied, however in the following description, with the exception of certain special cases, six plates 111 are used in the stacked plate assembly 11. Further, in the event it is necessary to mutually distinguish between the plates 111, branched reference characters are provided, in which the first plate 111 in the stacking direction is designated by 111-1, the second plate 111 in the stacking direction is designated by 111-2, . . . , and the sixth plate 111 in the stacking direction is designated by 111-6.

The plates 111 are manufactured, for example, from stainless steel, any one of which is the same in terms of being substantially disk shaped and of the same diameter. However, the shapes of the odd numbered plates 111 and the even numbered plates 111 in the stacking direction differ from each other. Below, the odd number plates 111 will be referred to as right side plates, and the even numbered plates 111 will be referred to as left side plates.

Figure 3:
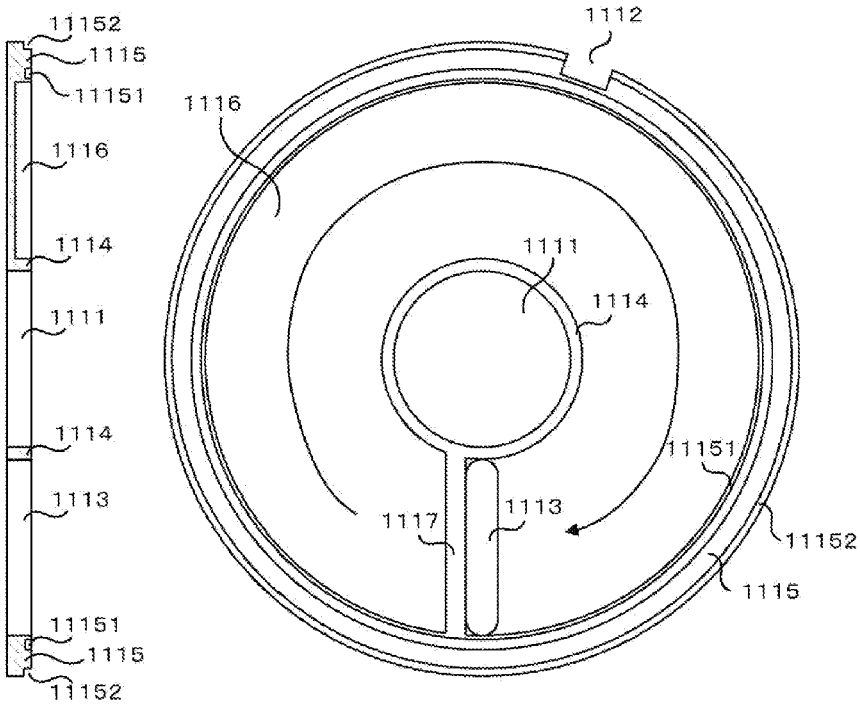
FIG. 3 shows a cross sectional view and a plan view of one of two types of plates that make up the stacked plate assembly of the heat exchanger according to the embodiment of the present invention.

FIG. 3 is a cross sectional view and plan view showing the shape of the right side plate 111. The right side plate 111 includes a through hole 1111 that is provided to penetrate in the stacking direction at a central position of a substantially disk-shaped body, a cutout 1112 disposed so as to penetrate in the stacking direction in a roughly rectangular shape on the outer edge of the substantially disk-shaped body, and a through hole 1113 provided to penetrate in the stacking direction with a narrow elongate shape in the radial direction of the substantially disk-shaped body.

The fixing tool 113 is inserted through and received in the through hole 1111. The cutout 1112 constitutes a portion of a first bypass forming a flow path for a first fluid that flows from a rear side toward a front side in the plan view of FIG. 3. The through hole 1113 constitutes a portion of a second bypass forming a flow path for a second fluid that flows from the front side toward the rear side in the plan view of FIG. 3.

As shown in the cross sectional view of FIG. 3, the right side plate 111 includes an inner wall 1114 that projects in a ring shape from the outer edge of the through hole 1111 in an opposite direction to the stacking direction, and an outer wall 1115 that projects in a ring shape from an outer edge of the right side plate 111 in an opposite direction to the stacking direction. In a front side surface as viewed from the outer wall 1115 in the stacking direction, a recess 11151, which is recessed in the stacking direction, is provided along the outer edge of the right side plate 111, so as to form an annular shape when viewed in the stacking direction. An o-ring 1121 is disposed in the recess 11151.

Further, on the outer wall 1115, a cutout 11152, which does not penetrate therethrough in the stacking direction, is provided on the outer edge of the right side plate 111 on a front side corner part thereof in the stacking direction. When viewed in the stacking direction, the cutout 11152 is substantially ring-shaped as a whole, although it is divided at the cutout 1112. A partition wall 1117 is arranged in the cutout 11152.

A hollow portion 1116, which opens toward the front in the plan view of FIG. 3, is formed between the inner wall 1114 and the outer wall 1115. The hollow portion 1116 constitutes a flow path for a second fluid that flows from the front side to the rear side in the plan view of FIG. 3.

Furthermore, a partition wall 1117 that extends in a radial direction connecting the inner wall 1114 and the outer wall 1115 is provided on the right side plate 111. The partition wall 1117 serves to prevent the second fluid, which flows from the front side to the rear side in the plan view of FIG. 3, from flowing directly into the through hole 1113. Due to the partition wall 1117, the second fluid, after having flowed in the direction of the arrow shown in FIG. 3, i.e., after having first flowed in an arcuate path about the axis in the stacking direction, then flows into the through hole 1113.

Incidentally, a partition wall 1117 is not provided in the plate 111-1. This is because, since a further upstream side plate 111 does not exist beyond the plate 111-1, there is no need to provide a partition wall 1117 for the plate 111-1. Notwithstanding, a partition wall 1117 may be provided on the plate 111-1 if desired. In this case, since the plate 111-1 can have the same shape as the other right side plates 111, manufacturing costs can be lowered when the right side plates 111 are mass produced.

Figure 4:
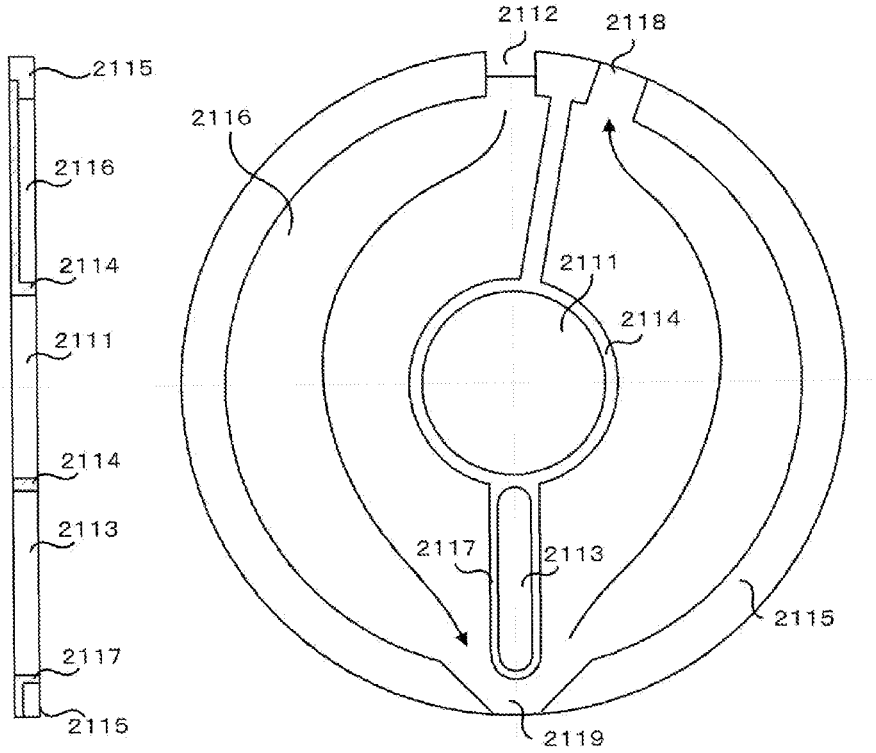
FIG. 4 shows a cross sectional view and a plan view of another one of the two types of plates that make up the stacked plate assembly of the heat exchanger according to the embodiment of the present invention.

FIG. 4 is a cross sectional view and plan view showing the shape of the left side plate 111. The left side plate 111 includes a through hole 2111 that is provided to penetrate in the stacking direction at a central position of a substantially disk-shaped body, a cutout 2112 disposed so as to penetrate in the stacking direction in a roughly rectangular shape on the outer edge of the substantially disk-shaped body, and a through hole 2113 provided to penetrate in the stacking direction with a narrow elongate shape in the radial direction of the substantially disk-shaped body.

The fixing tool 113 is inserted through and received in the through hole 2111. The cutout 2112 constitutes a portion of the first bypass that forms a flow path for the first fluid that flows from the rear side toward the front side in the plan view of FIG. 4. The through hole 2113 constitutes a portion of a second bypass forming a flow path for the second fluid that flows from the front side toward the rear side in the plan view of FIG. 4.

As shown in the cross sectional view of FIG. 4, the left side plate 111 includes an inner wall 2114 that projects in a ring shape from the outer edge of the through hole 2111 in an opposite direction to the stacking direction, and an outer wall 2115 that projects from an outer edge of the left side plate 111 in an opposite direction to the stacking direction. The outer wall 2115 is roughly ring-shaped as viewed in the stacking direction, however, the outer wall 2115 is separated at the position of the cutout 2112, at a position roughly 20 degrees around to the right from the aforementioned position about the center of the substantially disk-shaped left side plate 111, and at a position roughly 180 degrees around to the right from the position of the cutout 2112 about the center of the substantially disk-shaped left side plate 111.

As shown in the plan view of FIG. 4, at the position roughly 20 degrees around to the right from the cutout 2112 about the center of the left side plate 111, another cutout 2118 is provided that penetrates through the outer wall 2115 in the radial direction. The cutout 2118 in the plan view of FIG. 4 constitutes a portion of a second bypass that serves as a fluid path for the first fluid that flows from the front side of the left side plate 111 into another left side plate 111, which is arranged further on the front side thereof.

Further, at the position roughly 180 degrees around to the right from the cutout 2112 about the center of the left side plate 111, another cutout 2119 is provided that penetrates through the outer wall 2115 in the radial direction. The cutout 2119 is provided for securing a flow path for the first fluid, which flows in the direction of the arrows on the front side of the left side plate 111 in the plan view of FIG. 4.

A hollow portion 2116 that opens in the forward direction in the plan view of FIG. 4 is formed between the inner wall 2114 and the outer wall 2115. The hollow portion 2116 constitutes a flow path for the first fluid that flows from the front side to the rear side in the plan view of FIG. 4.

Furthermore, a partition wall 2117, which projects in a direction opposite to the stacking direction so as to surround the outer edge of the through hole 2113, is provided on the left side plate 111. Together with the inner wall 2114, the partition wall 2117 performs a role to partition the flow paths and prevent mixing of the second fluid, which flows through the through hole 2113 from the front side to the rear side in the plan view of FIG. 4, and the first fluid, which flows into the hollow portion 2116 from the rear side in the plan view of FIG. 4 and then flows out to the front side from the cutout 2118. Together therewith, the partition wall 2117 guides the first fluid so as to flow in the direction of the arrows in the hollow portion 2116, i.e., to flow in a circular arc about the axis in the stacking direction.

Figure 5:
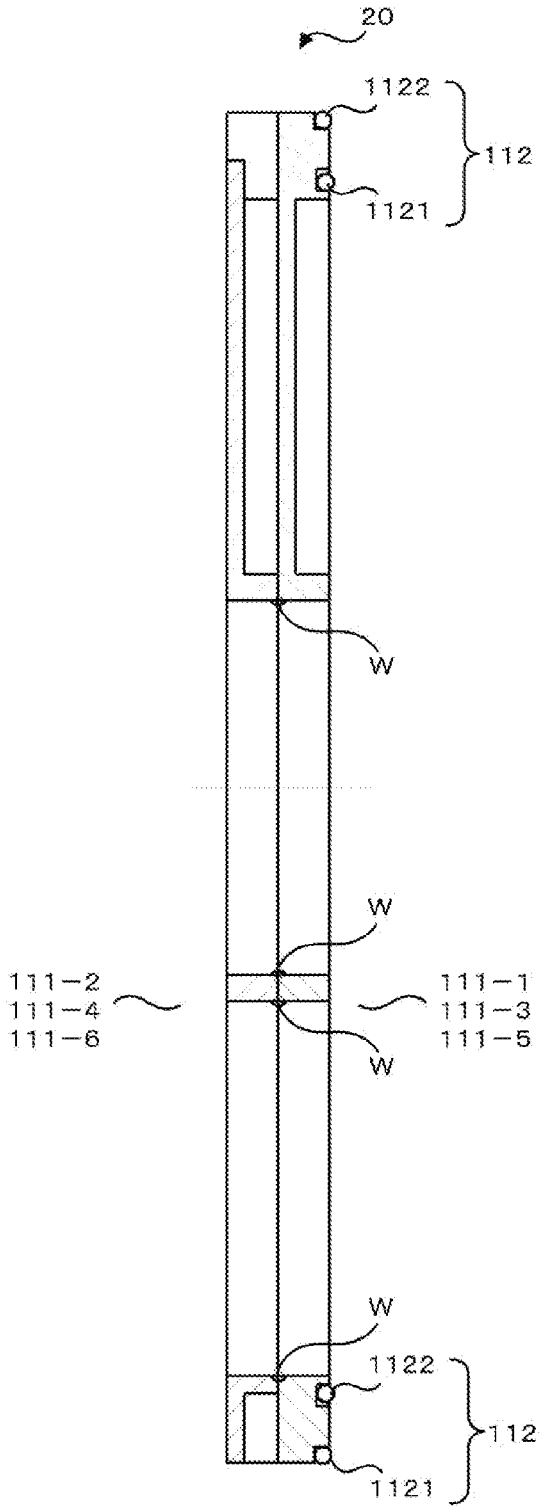
FIG. 5 is an outline view showing in cross section a plate set that makes up the stacked plate assembly of the heat exchanger according to the embodiment of the present invention.

After positioning of the mutually adjacent right side plate 111 and left side plate 111 has been carried out as viewed in the stacking direction, such that each of the through hole 1111 and the through hole 2111, as well as the through hole 1113 and the through hole 2113 are arranged in communication with each other, the rear surface (i.e., the rear surface in the plan view of FIG. 3) of the right side plate 111, and the front surface (i.e., the front surface in the plan view of FIG. 4) are fixed together, for example by welding, thereby sealing the passage of fluid from between the contact surfaces thereof. FIG. 5 is a cross sectional view of the plate set 20, which is made up from the right side plate 111 and the left side plate 111, which are fixed together in the foregoing manner. In FIG. 5, welding locations are indicated by the character W.

Hereinbelow, in the event it is necessary to distinguish between the plate sets 20, branched reference characters are provided, in which the first plate set 20 in the stacking direction is designated by 20-1, the second plate set 20 in the stacking direction is designated by 20-2, and the third plate set 20 in the stacking direction is designated by 20-3.

The plural plate sets 20 are overlapped in the stacking direction, and are fixed in predetermined positions in the interior of the casing 12 as a result of being pressed and sandwiched together by the casing 12 from the outer side toward the inner side in the stacking direction (see FIG. 1). At this time, the sealing members 112 are sandwiched between adjacent plate sets 20 and compressed, and as a result, face-to-face contact locations between the plate sets 20 are sealed.

For sandwiching the stacked plate assembly 11 in the stacking direction, the casing 12 comprises a right side pipe 121 arranged on an upstream side in the stacking direction, a tubular shaped left side pipe 122 arranged on a downstream side in the stacking direction, an annular spacer ring 123 arranged between the right side pipe 121 and the upstream side end outside edge of the stacked plate assembly 11, another annular spacer ring 124 arranged between the left side pipe 122 and the downstream side end outside edge of the stacked plate assembly 11, and a lock ring 125, which is a ring shaped body for locking a junction between the left side pipe 122 and the right side pipe 121 in a state of sandwiching the stacked plate assembly 11 via the spacer ring 123 and the spacer ring 124.

In the spacer ring 123, a cutout 1231 is provided, which constitutes a portion of a third bypass through which the first fluid, which flows out from the interior (hollow portion 2116) of the plate set 20 positioned on the upstream side end in the stacking direction of the stacked plate assembly 11, is guided to the exterior of the casing 12 via a through hole that penetrates through the wall of the casing 12.

In the spacer ring 124, a cutout 1241 is provided, which constitutes a portion of a fourth bypass that communicates with the exterior of the casing 12 via a through hole that penetrates through the wall of the casing 12, and through which the first fluid flows in from the exterior of the stacked plate assembly 11 into the interior (hollow portion 2116) of the plate set 20 positioned on the downstream side end in the stacking direction of the stacked plate assembly 11.

O-rings, which are made, for example, from silicone rubber, and which function as sealing members to prevent passage of fluid between the contact surfaces, are arranged respectively at contact surfaces between the spacer ring 123 and the right side pipe 121, at contact surfaces between the spacer ring 124 and the stacked plate assembly 11, and at contact surfaces between the spacer ring 124 and the left side pipe 122.

Further, on the outside of the through hole disposed in the wall of the casing 12, a tubular outflow pipe 127 forming a portion of the third bypass, which defines a flow path for discharging the first fluid from the stacked plate assembly 11, is attached so as to communicate with the cutout 1231 of the spacer ring 123. Similarly, on the outside of the through hole disposed in the wall of the casing 12, a tubular inflow pipe 126 forming a portion of the fourth bypass, which defines a flow path for inflow of the first fluid into the stacked plate assembly 11, is attached so as to communicate with the cutout 1241 of the spacer ring 124.

Although in FIG. 1, the inflow pipe 126 and the outflow pipe 127 are shown as being arranged on the outside surface of the casing 12 along the same line extending in the stacking direction, in actuality, the positions of the inflow pipe 126 and the outflow pipe 127 may be different when viewed in the stacking direction. Since in one plate set 20, the angle between the cutout 2118 constituting the fluid outlet port and the cutout 2112 constituting the fluid inlet port for the first fluid is 20 degrees, for example, in the case that three plate sets 20 are used to make up the stacked plate assembly 11, the positions of the fluid inlet port and the fluid outlet port for the first fluid are shifted by 60 degrees when viewed in the stacking direction.

Incidentally, in the case that a plurality of stacked plate sets 20 are tightened on the inside in the stacking direction only on the outer edge portions thereof by the right side pipe 121 and the left side pipe 122, it is easy, due to various causes, for the plate sets 20 to become deformed and bulge in the stacking direction in the vicinity of the central axes thereof. When such a deformation happens, gaps tend to occur between the partition walls 1117 of the right side plates 111 and the back surface of the left side plates 111 that confront the partition walls 1117, such that a portion of the second fluid does not flow in a circular arc in the hollow portion 1116 formed between the plate sets 20 as shown by the arrow in the plan view of FIG. 3, but rather flows directly into the through hole 1113 from the gap, and undesirably, sufficient heat exchange efficiency cannot be obtained. To avoid this type of problem, the fixing tool 113 is attached in the vicinity of the central axis as viewed in the stacking direction of the stacked plate assembly 11, whereby the plural plate sets 20 are tightened together inwardly in the stacking direction by the fixing tool 113.

The fixing tool 113, for example, is constituted by a bolt and a nut made from stainless steel. As viewed in the stacking direction of the stacked plate assembly 11, a through hole is formed in the stacking direction, which is created by connections between the through holes 1111 of the right side plates 111 and the through holes 2111 of the left side plate 111. After the bolt of the fixing tool 113 is inserted through the through hole formed in the stacked plate assembly 11, by tightening the nut thereon, fixing is carried out in the stacking direction in the vicinity of the center of the plural plate sets 20.

The structure of the heat exchanger 1 has been described above.

Next, an explanation shall be made concerning the manner in which heat exchange is carried out in the heat exchanger 1 between the first fluid and the second fluid.

The first fluid and the second fluid are fluids having a mutual temperature difference therebetween. Below, as an example, the first fluid will be considered as having a relatively low temperature, and the second fluid will be considered as having a relatively high temperature.

The first fluid is introduced into the inflow pipe 126 at a predetermined pressure from the exterior (see FIG. 1). The first fluid, which has been introduced into the inflow pipe 126, passes through the fourth bypass, which is constituted from the cutout 1241 of the spacer ring 124 and the cutout 2112 of the plate 111-6, and then flows into the hollow portion 2116 (first hollow portion) between the plate 111-6 and the plate 111-5.

As shown in FIG. 2, the first fluid enters the stacked plate assembly 11 through first inlet port 301. After the first fluid, which has flowed into the hollow portion 2116 (first hollow portion) between the plate 111-6 and the plate 111-5, has flowed through an arc of roughly 340 degrees about the center of the hollow portion 2116, the first fluid then flows through the first bypass, which is constituted from the cutout 2118 of the plate 111-6, the cutout 1112 of the plate 111-5, and the cutout 2112 of the plate 111-4, and flows into the hollow portion 2116 (first hollow portion) between the plate 111-4 and the plate 111-3.

Then, after the first fluid, which has flowed into the hollow portion 2116 (first hollow portion) between the plate 111-4 and the plate 111-3, has flowed through an arc of roughly 340 degrees about the center of the hollow portion 2116, the first fluid then flows through the first bypass, which is constituted from the cutout 2118 of the plate 111-4, the cutout 1112 of the plate 111-3, and the cutout 2112 of the plate 111-2, and flows into the hollow portion 2116 (first hollow portion) between the plate 111-2 and the plate 111-1.

Then, after the first fluid, which has flowed into the hollow portion 2116 between the plate 111-2 and the plate 111-1, has flowed through an arc of roughly 340 degrees about the center of the hollow portion 2116, the first fluid then flows through the third bypass, which is constituted from the cutout 2118 of the plate 111-2, the cutout 1112 of the plate 111-1, the first outlet port 320, and the cutout 1231 of the spacer ring 123, and flows out to the exterior of the heat exchanger 1 (see FIG. 1).

Portions of the wall surfaces of the fourth bypass and the first bypass are constituted by portions of the wall surfaces of the casing 12.

On the other hand, the second fluid is supplied so as to increase in pressure and flow from an upstream side to a downstream side in the stacking direction as viewed from the stacked plate assembly 11 in the interior of the casing 12. As shown in FIG. 2, the second fluid, which has increased in pressure and flowed from the upstream side in the stacking direction, flows through the bypass constituted from the through hole 1113 (or second inlet port 360) of the plate 111-1 and the through hole of the plate 111-2, and then flows into the hollow portion 1116 (second hollow portion) between the plate 111-2 and the plate 111-3.

After the second fluid, which has flowed into the hollow portion 1116 (second hollow portion) between the plate 111-2 and the plate 111-3, has flowed through an arc of roughly 340 degrees about the center of the hollow portion 1116, the second fluid passes through the second bypass constituted from the through hole 1113 of the plate 111-3 and the through hole 2113 of the plate 111-4, and then flows into the hollow portion 1116 (second hollow portion) between the plate 111-4 and the plate 111-5.

After the second fluid, which has flowed into the hollow portion 1116 (second hollow portion) between the plate 111-4 and the plate 111-5, has flowed through an arc of roughly 340 degrees about the center of the hollow portion 1116, the second fluid passes through the bypass constituted from the through hole 1113 of the plate 111-5 and the through hole 2113 (or second outlet port 370) of the plate 111-6, and then flows out toward the downstream side as viewed from the stacked plate assembly 11 in the interior of the casing 12.

In the foregoing manner, at the same time that the first fluid flows sequentially through the flow paths inside the multiple hollow portions 2116 (first hollow portions), which are connected in series by the first bypasses, the second fluid flows sequentially through the flow paths inside the multiple hollow portions 1116 (second hollow portions), which are connected in series by the second bypasses, whereby through each of the plates, heat conduction is carried out from the second fluid to the first fluid. As a result, heat exchange is performed between the first fluid and the second fluid.

As shown in FIG. 2, for forming the flow paths for the first fluid and the second fluid as discussed above, it is essential for each of the plate sets 20 to be arranged such that the plate set 20-2 is shifted to the left by roughly 20 degrees with respect to the plate set 20-1, and the plate set 20-3 is shifted to the left by roughly 20 degrees with respect to the plate set 20-2, around the central axis (i.e., the axis passing through the centers of the plate sets 20) in the stacking direction.

In the foregoing manner, by arranging the inflow pipe 126 so as to bite into the heat exchanger 1 in the middle of the conduit that forms the flow path for the second fluid, and so that the first fluid is introduced under pressure into the inflow pipe 126, which opens in a generally vertical direction with respect to the direction of flow of the second fluid, heat exchange can be carried out between the first fluid and the second fluid. Consequently, for example, compared to a situation in which a heat exchanger is disposed externally of the conduit forming the flow path for the second fluid, the piping arrangement is simplified, and a large amount of space is not required for installation of the heat exchanger 1.

Further, the first fluid flows out from the outflow pipe 127, which opens in a generally vertical direction with respect to the direction of flow of the second fluid. Therefore, when the circulating flow path of the first fluid is connected with respect to the heat exchanger 1, it is easy to maneuver and position the circulating flow path.

Furthermore, by changing the number of plate sets 20 that are used in the heat exchanger 1, the heat exchange capability of the heat exchanger 1 can easily be varied. Further, upon assembly of the heat exchanger 1, the heat exchanger 1 can simply be arranged in the interior of the casing 12 after the plural plate sets 20 have been stacked and the fixing tool 113 has been affixed therein, whereby assembly, disassembly, cleaning, etc., thereof can be performed easily and in a short time.

(Modifications)

The above-described embodiment can be modified in various ways within the scope of the technical concept of the present invention. Examples of such modifications are illustrated below.

In the above-described embodiment, as shown in FIG. 4, the cutout 2119 is disposed in the outer wall 2115 of the left side plate 111. The cutout 2119 is provided for ensuring a flow path for the first fluid in the interior of the hollow portion 2116, however, for example, in the case that a sufficient flow path for the first fluid is assured by shortening the length in the radial direction of the through hole 2113, the cutout 2119 can be dispensed with (see FIG. 6).

Figure 7:
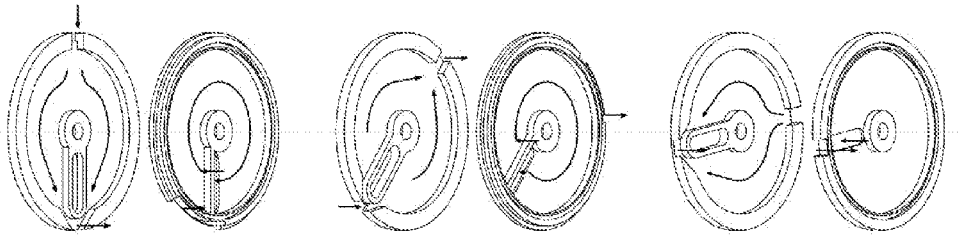
FIG. 7 is a view showing the flow of fluids in a modified example of a stacked plate assembly of the heat exchanger according to the embodiment of the present invention.

Further, in the above-described embodiment, in the case of a constant flow velocity of the fluids, by making the flow paths of the first fluid and the second fluid longer, the time required for performing heat exchange is lengthened and the heat exchange capability of the heat exchanger 1 is increased. If the flow paths for the fluids are lengthened, although the heat exchange capability can be increased, resistance to flow also increases when the fluids flow. Accordingly, for example, in the case that the viscosity of the first fluid is high, the force required to introduce the first fluid becomes too high in pressure. In such a case, in order to decrease the resistance of the first fluid, a structure may be adopted in which the shapes of the left side plate 111 and the right slide plate 111 may be modified to the shapes shown in FIG. 7, wherein the positions of the fluid inlet port and the fluid outlet port for the first fluid in the plate set 20 are shifted by 180 degrees around the central axis of the plate set 20.

Further, the heat exchanger 1 may be constructed such that a fan is provided in the casing 12 for generating flow of the second fluid in the aforementioned stacking direction. As a result of the heat exchanger 1 having such a structure, flow of the second fluid is generated by rotation of the fan, so that heat exchange can be carried out even in a situation where it is difficult to arrange an apparatus to introduce the second fluid under pressure from the exterior.

The term "fan" in the present specification refers broadly to a fluid pressure device, including devices such as various types of propellers, impellers, compressors, or the like.

Further, as viewed in the stacking direction, the plates 111 and the casing 12 are substantially disk-shaped, however, the shape thereof can be arbitrarily changed. For example, if the shape of the plates 111 and the casing 12 as viewed in the stacking direction is generally an eighteen-sided regular polygon, when positioning of the mutually adjacent plate sets 20 is carried out, then if one of the plate sets 20, which is arranged in the same position and shape as viewed in the stacking direction, is rotated about the central axis in the stacking direction, so that the vertices thereof correspond to such an eighteen-sided regular polygon, then a 20 degree shift between the adjacent plate sets 20 can be realized reliably.

In this manner, by determining the shape of the plates 111 so as to be of the same shape when the plate sets 20 are shifted and rotated around the central axis by the same angle, positioning between the plate sets 20 is facilitated. The plates 111 are not limited to having the shape of an eighteen-sided regular polygon, but any shape may be employed that can reproduce the same shape when rotated by a predetermined angle.

In the embodiment discussed above, adjacent plate sets 20 are arranged so as to be rotated at an angle of 20 degrees around the central axis, however, the angle between adjacent plate sets 20 may be arbitrarily changed. If the angle is made smaller, then the cross sectional area of the second bypass, which forms the flow path for the first fluid, becomes smaller, whereas the flow paths of the first fluid and the second fluid can be lengthened, and the heat exchange capability can be increased. On the other hand, if the angle is made larger, then although the heat exchange capability decreases, since the cross sectional area of the second bypass can be widened, such a situation may be desirable in the case of a high viscosity second fluid, for example.

Further, in the aforementioned embodiment, the first fluid flows in from the inflow pipe 126 and flows out to the exterior of the heat exchanger 1 from the outflow pipe 127, however, the flow of the first fluid may be in the opposite direction. More specifically, the circulation passage of the first fluid may be connected to the heat exchanger 1 such that the first fluid is introduced under pressure from the outflow pipe 127 and flows out of the heat exchanger 1 from the inflow pipe 126.

Similarly, the flow direction of the second fluid may be opposite to that in the above-described embodiment. More specifically, introduction of the second fluid may be carried out such that the second fluid flows from the left side to the right side in FIG. 1.

Allowing the temperature difference between the first fluid and the second fluid to become unnecessarily large at certain locations in the heat exchanger 1 is not desirable, due to the reason that damage may be brought about in the heat exchanger 1 by a difference in the ratio of thermal expansion. In relation to this point, the flow paths for the first fluid and the second fluid are formed by sequentially connecting the hollow portions formed between adjacent plates 111, and since the flow direction of the first fluid and the flow direction of the second fluid, which flow respectively in the flow paths, can be made mutually opposite to each other, the temperature difference between the two types of fluids that come into mutual contact via the plates 111 can be kept small throughout the entire region of the flow paths.

For example, in the case that the first fluid is relatively low in temperature whereas the second fluid is relatively high in temperature, the first fluid, which has just flowed in from the inflow pipe 126, undergoes heat exchange with the second fluid, from which heat has been absorbed and is low in temperature. Also, the first fluid that flows past in the vicinity of the outflow pipe 127, in a condition of having absorbed heat and been made higher in temperature, undergoes heat exchange with the high temperature second fluid, which has not yet been lowered in temperature. Accordingly, the temperature difference between the first fluid and the second fluid, which are in mutual contact via the plates 111, is averaged, resulting in a safe situation in which locally large temperature differences are not brought about.

Further, the materials used for the various constituent elements of the heat exchanger in the above-described embodiment can be freely varied. For example, a material apart from silicone rubber may be employed as the sealing members. Further, as materials for the plates 111, the casing 12, or the fixing tool 113, materials apart from stainless steel can be used. For example, by adopting a material having high heat conductivity such as copper or the like for the plates 111, the heat exchange rate can be increased.

Further, although the fixing tool 113 is constituted from a bolt and a nut, another type of fixing tool may be used which is capable of fastening the stacked plate assembly 11 in the axial direction. Furthermore, in the event there is no concern over deformation of the plate sets 20, the fixing tool 113 may be dispensed with.

Further, in the aforementioned embodiment, adjacent contact surfaces (end parts thereof) between the rear surface of the right side plate 111 and the front surface of the left side plate 111 are affixed together by welding. However, the fixing method is not limited to welding, and any of various other fixing methods may be adopted that are capable of sealing the fluid. For example, the contact surfaces may be affixed together mutually by an adhesive.

Further, in place of constructing the plate sets 20 by affixing adjacent contact surfaces between the front surface of the left side plate 111 and the rear surface of the right side plate 111, similar to sealing between the plate sets 20, a structure may be adopted in which sealing members such as o-rings or the like are arranged between the front surface of the left side plate 111 and the rear surface of the right side plate 111, so that sealing is carried out therebetween by sandwiching and pressing the sealing members between the right side plate 111 and the left side plate 111.

Further, instead of performing sealing by pressing sealing members between adjacent plate sets 20, a structure may be adopted in which sealing is performed by fixing the plate sets 20 by means of welding or use of an adhesive or the like.

Figure 6:
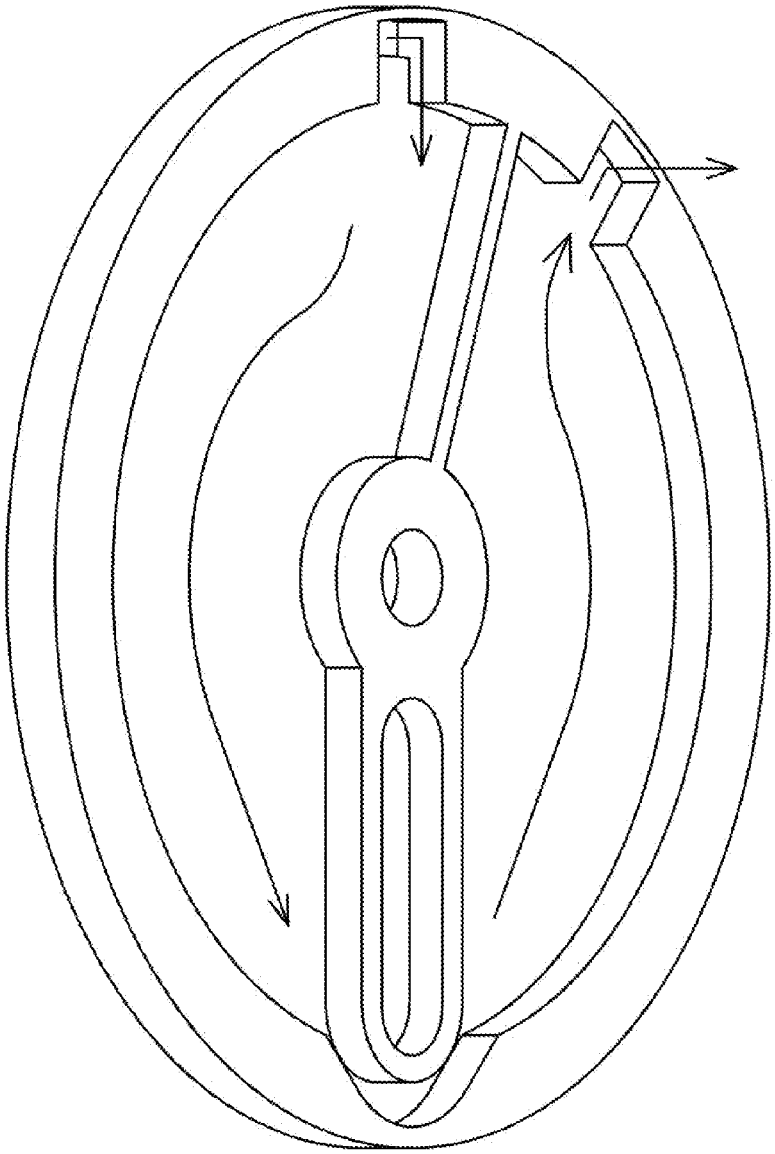
FIG. 6 is a perspective view of a modified example of a plate that makes up part of the stacked plate assembly of the heat exchanger according to the embodiment of the present invention.

Further, instead of accommodating the stacked plate assembly 11 inside the casing 12, a structure may be adopted in which, for example, a wall surface is provided for forming the first bypass, and in which an inflow pipe 126 through which the second fluid flows into the stacked plate assembly 11 is connected to the through hole 1113 of the plate 111-1, and an outflow pipe 127 that receives the second fluid that flows out from the stacked plate assembly 11 is connected to the through hole 2113 of the plate 111-6. A perspective view of a left side plate 111 according to such a modification is shown in FIG. 6.

Further, in the above-described embodiment, the arrangement of the flow path for the first fluid and the arrangement of the flow path for the second fluid are capable of being varied.

For example, although the first bypass is arranged on the outer edge of the plate 111, and the second bypass is arranged so as to penetrate through the inner side of the plate 111, the arrangements thereof are capable of being arbitrarily varied.

Figure 8:
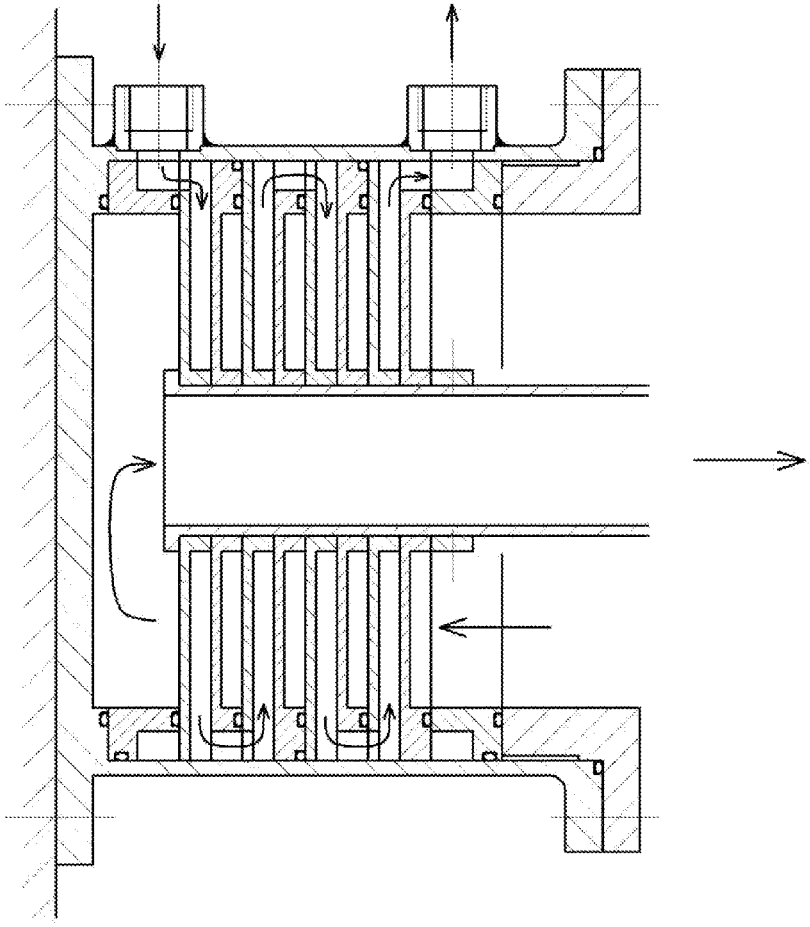
FIG. 8 is a view showing in outline an image of the flow of fluids in the interior of a heat exchanger according to a modified example of the embodiment of the present invention.

For example, FIG. 8 shows a modified example in which the flow paths for the fluids is modified from the aforementioned embodiment. In the modified example of FIG. 8, one side of the casing 12 is not open, and the axis of the tubular body is arranged perpendicularly with respect to the wall. In this case, since the second fluid cannot flow further in a leftward direction in FIG. 8, a bypass is arranged on the inside of the through holes 1111 and the through holes 2111, and a pipe is disposed therein that serves as a flow path for the second fluid.

Figure 9:
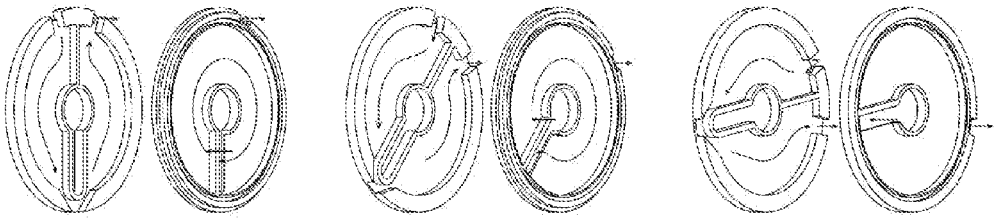
FIG. 9 is a view showing the flow of fluids in the interior of a stacked plate assembly of the heat exchanger according to the modified example of the embodiment of the present invention.

In the case that a pipe is arranged on the inside of the through holes 1111 and the through holes 2111, since there is no concern over the second fluid, which flows in circular arcs and passes through the through holes 1113 and the through holes 2113, circumventing the through holes 2111 and the through holes 2111, as shown in FIG. 9, each of the through holes 1111 and the through holes 1113 as well as the through holes 2111 and the through holes 2113 can be adjoined into one through hole. As a result, the area provided by the through holes 1113 and the through holes 2113 increases, and fluid resistance in relation to the second fluid can be decreased.

Further, the first fluid was described as flowing in circular arcs in the interiors of the hollow portions 2116 and the second fluid was described as flowing in circular arcs in the interiors of the hollow portions 1116, however, for example, a structure may be provided in which, in the interiors of the hollow portions, flow paths of various other shapes, such as spiral flow paths or swirling flow paths or the like, are used. Further, the fluid inflow and fluid outflow positions of the first fluid and the second fluid in the heat exchanger 1, as well as the directions thereof, are capable of being modified arbitrarily.

Further, in the aforementioned embodiment, although as an example, it has been described that the first fluid is relatively low in temperature whereas the second fluid is relatively high in temperature, the relative temperatures of the fluids may be reversed.

Further, the fluids in the present application are all types of fluids including both liquids and gasses.

INDUSTRIAL APPLICABILITY

The present invention is capable of being applied to various types of apparatus that require or make use of heat exchange. Further, since it is capable of being mass produced, the present invention can be used in so-called service industries such as various manufacturing and retail industries or the like.

EXPLANATION OF REFERENCE CHARACTERS

1 . . . heat exchanger
11 . . . stacked plate assembly
12 . . . casing
20 . . . plate set
111 . . . plate
112 . . . sealing members
113 . . . fixing tool
121 . . . right side pipe
122 . . . left side pipe
123 . . . spacer ring
124 . . . spacer ring
125 . . . lock ring
126 . . . inflow pipe
127 . . . outflow pipe

What is claimed is:

1. A heat exchanger comprising:

a stacked plate assembly having n stacked plates, where n is a natural number constant satisfying the relation $5 \leq n$;

on each of two mutually adjacent plates from among said n plates, hollow portions are formed between said two plates;

among at least one first hollow portion, which is formed between a Hth plate, where $H=2x-1$, and a Ith plate, where $I=2x$, counting in a direction from one end to another end in the stacking direction of said n plates, where x is a natural number variable satisfying the relation $2x \leq n$, a closest first hollow portion to said one end in said stacking direction comprises a first outlet port that communicates with an exterior of said stacked plate assembly;

among said at least one first hollow portion, a closest first hollow portion to said other end in said stacking direction comprises a first inlet port that communicates with the exterior of said stacked plate assembly;

a first bypass is provided that interconnects each of two mutually adjacent first hollow portions from among two or more first hollow portions for forming a single flow path for fluid from the first inlet port to the first outlet port through the two or more first hollow portions sequentially;

among at least one second hollow portion, which is formed between a Jth plate, where $J=2y$, and a Kth plate, where $K=2y+1$, counting in a direction from said one end to said other end in the stacking direction of said n plates, where y is a natural number variable satisfying the relation $2y+1 \leq n$, a closest second hollow portion to said one end in said stacking direction comprises a second inlet port that communicates with the exterior of said stacked plate assembly;

among said at least one second hollow portion, a closest second hollow portion to said other end in said stacking direction comprises a second outlet port that communicates with the exterior of said stacked plate assembly;

a second bypass is provided that interconnects each of two mutually adjacent second hollow portions from among two or more second hollow portions for forming a single flow path for fluid from the second inlet port to the second outlet port through the two or more second hollow portions sequentially;

said first hollow portion and said second hollow portion are separated mutually from each other, so that fluid does not flow between said first hollow portion and said second hollow portion;

each of said at least one first bypass is arranged along an outer side surface of a second hollow portion that is positioned between two first hollow portions which are connected mutually by said first bypass in said stacking direction; and each of said at least one second bypass is arranged to penetrate through an inner side of a first hollow portion that is positioned between two second hollow portions which are connected mutually by said second bypass in said stacking direction, each of said at least one second bypass being performed by a partition wall separating the second bypass from the first hollow portion.

2. A heat exchanger according to claim 1, further comprising a hollow cylindrical casing which extends in the stacking direction and accommodates the stacked plate assembly in an interior thereof;

hollow portions of said casing are separated by said stacked plate assembly into a hollow portion positioned on said one end side and a hollow portion positioned on said other end side in said stacking direction;

said first outlet port is connected to the exterior of said casing through a third bypass that penetrates through a wall surface of said casing;

said first inlet port is connected to the exterior of said casing through a fourth bypass that penetrates through a wall surface of said casing;

said second inlet port is opened with respect to the hollow portion positioned on said one end side from among the hollow portions of said casing; and said second outlet port is opened with respect to the hollow portion positioned on said other end side from among the hollow portions of said casing.

3. A heat exchanger according to claim 2, wherein a portion of a wall surface of each of said at least one first bypass constitutes a wall of said casing.

4. The heat exchanger according to claim 2, wherein a fan is provided inside said casing that causes the fluid to flow in said stacking direction.

5. The heat exchanger according to claim 2, wherein a tubular body is provided, which forms a separate fluid path that penetrates in the stacking direction in the interior of said stacked plate assembly communicating between the hollow portion positioned on said one end side and the hollow portion positioned on said other end side among the hollow portions of said casing, such that fluid does not flow through any of said first hollow portions, said first bypasses, said second hollow portions, and said second bypasses, except for said second hollow portion that is connected via said fourth opening.

6. The heat exchanger according to claim 1, wherein an adjacent two plates from among at least two Vth positioned plates, where $V=2p-1$ and p is a natural number variable satisfying the relation $2p-1 \leq n$, counting in a direction from said one end to said other end in the stacking direction of said n plates have the same shape; and said two plates, which have the same shape, are stacked in a condition of being rotated through a predetermined angle about a common axis that extends in the stacking direction from a position at which the shapes thereof are in agreement as viewed in said stacking direction.

7. The heat exchanger according to claim 1, wherein at least an adjacent two plates from among at least two Wth positioned plates, where $W=2q$ and q is a natural number variable satisfying the relation $2q \leq n$, counting in a direction from said one end to said other end in the stacking direction of said n plates have the same shape; and said two plates, which have the same shape, are stacked in a condition of being rotated through a predetermined angle about a common axis that extends in the stacking direction from a position at which the shapes thereof are in agreement as viewed in said stacking direction.

8. The heat exchanger according to claim 6, wherein, in relation to each of said n plates, shapes in which outer edges of said plates are projected in the direction of said common axis are of the same shape before and after being rotated through said predetermined angle about said common axis.

9. The heat exchanger according to claim 1, wherein $n=2m$, where m is a natural number variable satisfying the relation $2 \leq m$;

said first hollow portion is formed by mutually securing together a Cth positioned plate, where $C=2r-1$ and r is a natural number variable satisfying the relation $r \leq m$) counting in a direction from said one end to said other end in said stacking direction of said two plates, and a Dth positioned plate, where $D=2r$, counting in a direction from said one end to said other end in said stacking direction of said two plates, thereby constituting each of respective rth positioned plate sets counting in a direction from said one end to said other end in said stacking direction; and said second hollow portion is formed by disposing a sealing material between an sth positioned plate set, where s is a natural number variable satisfying the relation $s+1 \leq m$ counting in a direction from said one end to said other end in said stacking direction of said plate sets, and a Tth positioned plate set, where $T=s+1$, counting in a direction from said one end to said other end in said stacking direction of said plate sets, and pressing the two plate sets with respect to the sealing material.

10. The heat exchanger according to claim 1, wherein, in relation to at least one of said first hollow portion and said second hollow portion, a partition plate is provided that impedes flow a fluid in a longitudinal direction from a center of the hollow portion to an outer edge thereof.

11. The heat exchanger according to claim 3, wherein a fan is provided inside said casing that causes the fluid to flow in said stacking direction.

12. The heat exchanger according to claim 7, wherein a structure is adopted in which, in relation to each of said n plates, shapes in which outer edges of said plates are projected in the direction of said common axis are of the same shape before and after being rotated through said predetermined angle about said common axis.

13. The heat exchanger according to claim 1, further comprising:

a longitudinal axis of the stacked plate assembly;

a first plate, the first plate being one of the n stacked plates;

a first left partition wall and a first right partition wall of the first plate, the first right partition wall generally positioned clockwise, relative to the longitudinal axis, from the first left partition wall;

a third plate, the third plate being one of the n stacked plates;

a third left partition wall and a third right partition wall of the third plate, the third right partition wall generally positioned clockwise, relative to the longitudinal axis, from the third left partition wall;

wherein the third left partition wall is generally positioned clockwise, relative to the longitudinal axis, from the first right partition wall.

14. The heat exchanger according to claim 13, further comprising:

a second plate, the second plate being one of the n stacked plates;

a second flat body of the second plate;

a second right partition wall of the second plate, the second right partition wall generally aligned adjacent to the first right partition wall;

wherein the first left partition wall, the first right partition, the second right partition, and the second flat body form the second bypass.

* * * * *